United States Patent [19]

Goldring et al.

[11] 4,091,858

[45] May 30, 1978

[54] APPARATUS FOR MAKING MOLDS BY SEQUENTIAL SQUEEZING

[76] Inventors: Grigory Mikhailovich Goldring, ulitsa Zernovaya, 6/6 kv. 57; Semen Nusievich Koiler, prospekt 50-letia VLKSM, 67, kv. 47; Vladimir Fedorovich Losev, 531 mikroraion, ulitsa Shironintsev, 50v, kv. 12; Vladimir Danilovich Pepenko, Proviantsky pereulok, 1a, kv. 51; Evgeny Ivanovich Platov, ulitsa Anri Barbjusa, 3, kv. 14, all of Kharkov; Benedikt Veniaminovich Rabinovich, ulitsa Vavilova, 48, kv. 401, Moscow; Jury Viktorovich Sakhanovich, prospekt Frunze, 22, kv. 9, Kharkov, all of U.S.S.R.

[21] Appl. No.: 523,063

[22] Filed: Nov. 12, 1974

[51] Int. Cl.[2] ..... B22C 15/08; B22C 17/06

[52] U.S. Cl. ..... 164/212; 164/188; 164/194; 164/218

[58] Field of Search ..... 164/37, 40, 207, 210, 164/212, 187, 188, 194, 218, 169, 180, 190, 195, 217, 219

[56] References Cited

U.S. PATENT DOCUMENTS

| | | | |
|---|---|---|---|
| 532,214 | 1/1895 | Richards | 164/210 |
| 3,169,285 | 2/1965 | Hatch et al. | 164/210 X |
| 3,552,477 | 1/1971 | Rabinovich et al. | 164/188 |
| 3,709,282 | 1/1973 | Taccone | 164/187 |

FOREIGN PATENT DOCUMENTS

| | | |
|---|---|---|
| 314,780 | 9/1969 | Sweden. |

*Primary Examiner*—Francis S. Husar
*Assistant Examiner*—Gus T. Hampilos
*Attorney, Agent, or Firm*—J. Harold Nissen

[57] ABSTRACT

An apparatus is provided comprising two independent driving units: a main squeeze cylinder moving flask-and-pattern accessories to a squeeze board and an auxiliary actuating cylinder transferring the pattern along the line of molding. The auxiliary actuating cylinder is built into a pedestal mounted on the main squeeze cylinder piston rod and connected with the pattern by quick-release sectional lock-type clamping means of the hook-slot type enabling a shuttle mechanism carrying the flask-and-pattern accessories to be transferred from station to station. The pedestal is mounted at the compacting station so that is is capable of functioning as a sand jolting mechanism.

5 Claims, 2 Drawing Figures

APPARATUS FOR MAKING MOLDS BY SEQUENTIAL SQUEEZING

Figure 1:
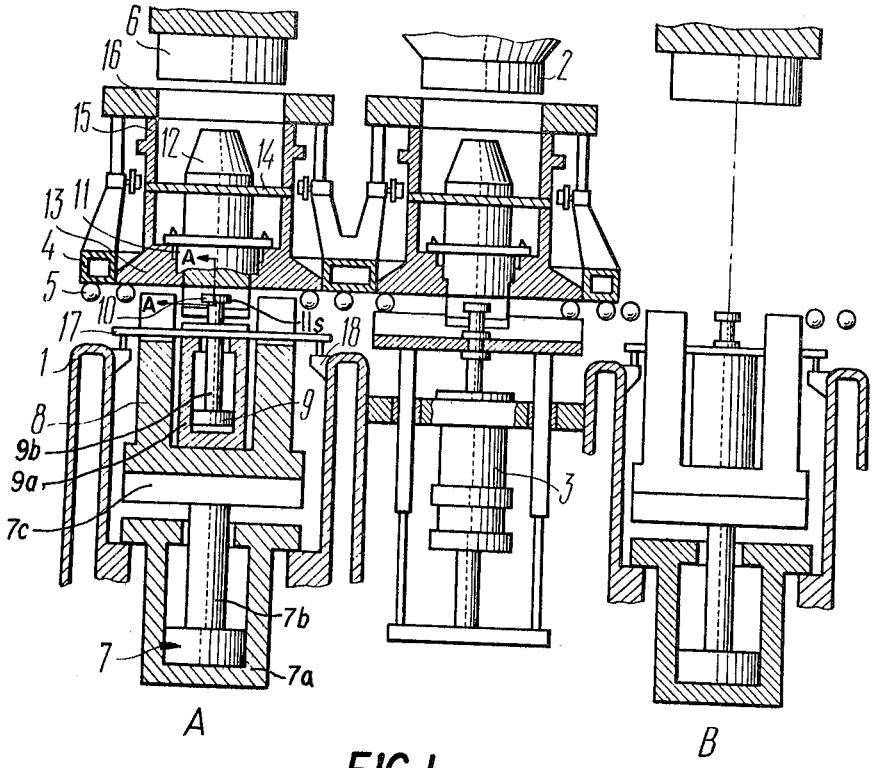

The present invention relates to improvements in molding machines employed in foundry practice and more particularly to three-station molding machines for making molds by sequential squeezing. A molding machine for the manufacture of molds through the use of squeezing is well known in the art which comprises a shuttle device with pattern tooling, a frame with piston cylinders for compacting molding sand and squeeze boards mounted thereon as well as devices for filling flasks with molding sand and a pattern withdrawal gear (e.g. the type KB301 three-station molding machine of Konkel-Wagner & Co. K.G. installed in the automatic line at the Likhachev Moscow Automative Works).

Pattern plates in such a machine are mounted on a shuttle device and move therewith from a central station to side ones whereas the pattern is rigidly secured to the pattern plate having no stripper frame.

Withdrawal of the pattern is effected by a gear lifting the flask from the pattern plate. On the side stations are installed jolting-squeezing mechanisms and squeeze boards.

A method has previously been proposed for producing molds by squeezing (Author's certificate No. 26380, USSR; patents: France (No. 1.584.455); (U.S. Pat. No. 3.552.447); Sweden (No. 314.780); Great Britain (No. 1.179.815); Italy (No. 811.193); Belgium (No. 702.937); DDR (No. 63.612) consisting in that compaction of mold halves is done by means of pre-forcing of the pattern into molding sand with subsequent squeezing by the stripper plate (sequential squeezing).

The above technique of mold compaction, however, can not be utilized on the foregoing machine since herein it is impossible to provide individual displacement of separate members of flask-and-pattern accessories in the process of compaction.

An object of the present invention is to provide an apparatus for making molds by using a sequential squeezing procedure which enables the pattern to be moved upward and downward independent of other members of the flask-and-pattern accessories.

Another object of the present invention is to provide a molding apparatus permitting the sequential squeezing technique to be performed through the use of simple in design and inexpensive technical means which require no considerable reconstruction of known machines designed for similar purposes. Still another object of the present invention is to provide a three-station molding machine wherein sequential squeezing of molds will be accomplished in a most efficient and economical way.

To achieve these and other objects, the proposed apparatus in accordance with the present invention comprises a main squeeze cylinder upon the movable member on which is mounted an auxiliary actuating mechanism coupled with the pattern by sectional connecting means and adapted to separately move the pattern with respect to other members of the flask-and-pattern accessories both in the direction of a squeeze pressure exerted by the main cylinder and in the opposite direction.

Such a design enables the pattern to be displaced with regard to the stripper plate and the flask in the course of molding sand compaction.

Another embodiment of the present invention provides for an apparatus wherein said actuating mechanism is designed in the form of a pedestal supported by the free end of the main squeeze cylinder movable member, which pedestal accomodates a power cylinder whose piston rod is connected with the pattern by sectional lock-type clamping means.

The apparatus according to the invention provides a supporting surface for the pattern plate which is necessary for compacting molding. The apparatus further simplifies the actuating mechanism since a single power cylinder can be used for the pattern drive. It also ensures mobility of the pattern during its replacement and movement from the compacting station to the withdrawing one.

According to a further embodiment of the present invention, there is provided an apparatus wherein said main squeeze cylinder and said auxiliary actuating mechanism are so mounted that their piston rods have a common axis coinciding with the axis of squeezing, said lock-type clamping means being made in the form of two members each engaging other components of the hook-and-slot type, one member being tied with the actuating mechanism piston rod whereas the other member being coupled with the pattern.

Such a design improves the operating conditions of the main squeeze cylinder thereby increasing its service life.

According to another particular embodiment of the present invention, there is provided an apparatus for making molds by sequential squeezing designed on the basis of the three-station molding machine scheme comprising a shuttle mechanism and tandem stations for molding sand compaction. In addition, there is also provided a station for filling flasks with molding and equipped with a pattern lifting and withdrawal gear, these stations being adapted to simultaneously perform the above operations on two sets of flask-and-pattern accessories being moved by the shuttle mechanism from station to station, which apparatus is characterized in that at each of these stations there is a self-contained unit including a main squeeze cylinder with an auxiliary actuating mechanism, the members of the lock-type clamping means connected with patterns being adapted to readily engage any adjacent member of clamping means attached to the piston rod of the auxiliary actuating mechanism or that of the pattern lifting and withdrawal gear as the shuttle mechanism moves from station to station.

This embodiment of the invention provides for an increase in the production capacity of the molding machine since makes it possible to simultaneously perform necessary operations at different stations.

According to a further embodiment of the present invention, an apparatus is provided characterized in that said members of the lock-type clamping means connected with patterns are lugs with slots whose axis is parallel to the common axis of the stations and which can readily enter clamping mushroom members secured to the piston rods of the actuating mechanisms at each station, these piston rods being tied with devices ensuring proper orientation of the mushroom members in the center of said slots for free movement from station to station.

The apparatus according to the invention further allows dependable connection of each of the patterns to the corresponding actuating mechanism.

Still another embodiment of the present invention contemplates the provision of an apparatus wherein said device consists of a crossover strap connected to the actuating mechanism piston rod and positioned at a predetermined height with regard to the pattern along the axis of squeezing and adjustable fixed stops, said crossover connection coming in contact with the actuating mechanism piston rod in its lower position.

In addition, the apparatus may be characterized in that said device includes a compression spring inserted beneath the auxiliary actuating mechanism piston and acting in the direction of squeezing.

The invention provides for an appropriate clearance to be formed between the members of the lock-type clamping means.

According to a further embodiment of the present invention an apparatus is provided wherein at one of the compacting stations there is installed said actuating mechanism whereas at the other compacting station *a* jolting mechanism is mounted in place of the actuating mechanism.

The invention broadens the inherent technological potentialities of the machine ensuring, dependent on the individual features of the pattern, mold compaction by a technique most expedient for a particular case.

According to an additional form of the present invention, the apparatus is characterized in that the auxiliary actuating mechanism pedestal is provided in the form of a mold jolting mechanism, the members thereof encircling the power cylinder, whereas the pattern-and-flask accessories are supported during the squeeze on the jolting mechanism table.

The above design feature makes the apparatus more unique in application and enables it to be used most effectively for simultaneous compacting of various patterns at different stations of the machine.

And, finally, according to the present invention, the apparatus is characterized in that the power cylinder casing is made integral with the jolting mechanism piston.

This is one of the most optimum embodiments of the jolting mechanism under the operating conditions of said molding machine.

Figure 2:
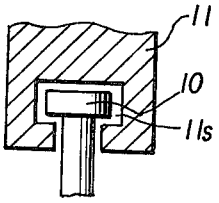

Other objects, advantages and the nature of the invention will become readily apparent from the following detailed description of the invention taken in connection with the accompanying drawings:

FIG. 1 is a schematic diagram of a molding machine in accordance with the invention; and, FIG. 2 is a detail of a lock-type connection partially in section taken along line A—A of FIG. 1.

The machine comprises a frame 1 whereupon are disposed two stations A and B for molding sand compaction and a station 2 of filling flasks with molding sand equipped with a pattern lifting and withdrawal gear mechanism 3, these stations being adapted to perform said operations simultaneously on two sets of pattern-and-flask accessories moved from station to station by a shuttle mechanism 4 using a roller conveyor 5.

The compacting station includes a top traverse with a squeeze board 6 and a main squeeze cylinder arrangement 7 including a cylinder 7*a* of the main squeeze cylinder arrangement and a piston rod 7*b* mounted on the machine frame 1.

The main squeeze cylinder piston rod 7*b* mounts an auxiliary actuating mechanism 7*c* comprising a pedestal 8 enclosing a power cylinder arrangement 9 including a cylinder 9*a* and a piston rod 9*b*.

The piston rods 9*b* of the power cylinders 9 fitted with clamping mushroom members 10 and lugs 11 of patterns 12 provided with through slots 11*s* whose axis is parallel to the common axis of all the stations, form sectional lock-type clamping means adapted to readily engage any adjacent member of clamping means secured to the piston rod of the auxiliary actuating mechanism or the pattern lifting and withdrawal gear mechanism 3 as the shuttle mechanism 4 moves from station to station.

Connected to said piston rods of the power cylinders 9 are devices providing for proper orientation of the mushroom members in the center of said slots to ensure free movement from station to station of the shuttle gear mechanism 4 with the flask-and-pattern accessories including the patterns 12 with pattern plates 13, stripper plates 14, flasks 15, filling frames 16.

These devices may be provided in the form of a crossover connection 17 tied with the auxiliary actuating mechanism piston rod and positioned at a predetermined height with respect to the pattern plate 13 along the axis of squeezing, and adjustable fixed stops 18, said crossover connection coming in contact therewith when the actuating mechanism piston rod is in its lower position, thereby lifting the piston rod relative to the lug slot and forming a necessary clearance between the members of the lock-type clamping means.

In addition, the above effect may be attained through the use of a compression spring inserted beneath the piston 9*b* of the power cylinder 9, which spring will lift the piston a distance equal to the amount of precompression as soon as the pressure in the piston rod chamber of the power cylinder 9 is relieved.

The machine operates as follows.

The empty flask 15 is fed to the central station of the machine and upon being filled with molding sand is conveyed by the shuttle mechanism 4 to the compacting station.

In the initial position, the piston rod 7*b* of the main squeeze cylinder 7 is in its extreme lower position, the piston rod 9*b* of the power cylinder 9 is supported by the crossover connection 17 which in turn, via the adjustable stops 18, is supported by the frame 1. The above position of the piston rod provides for the shuttle mechanism 4 with flasks, patterns and related accessories to be transferred from the station of sand filling and pattern withdrawal to the compacting station, thereby forming necessary clearances in the clamping assembly.

During its preliminary stroke the main squeeze cylinder 7 takes up all transport clearances in the lock-type clamping means and also forms a clearance between the pedestal 8 and the pattern plate 13. The power cylinder 9 pre-forms the pattern 12 into the molding sand contained in the flask 15. Next, the main squeeze cylinder 7 while moving upward in the direction of the squeeze board 6, accomplishes squeezing of the modling sand by the stripper plate 14. At the same time, the piston rod of the power cylinder 9 with the help of the mushroom member 10 displaces the lug 11 with the pattern 12 downward thereby providing for the pattern to be fixedly positioned with respect to the frame 1.

Upon completion of the squeezing operation, the piston rod of the main squeeze cylinder is lowered, whereas the crossover connection 17 gets supported on the stops 18 of the frame 1 thereby keeping the piston rod of the power cylinder 9 with the mushroom member 10 at a level required to form a clearance between the mushroom member 10 and the lug 11. Upon completion of the mold compaction the flask-and-pattern accessories are carried by the shuttle mechanism 4 to the central station wherein the pattern is withdrawn and the finished half-mold is turned out.

In the process of operation a need may arise to simultaneously place different patterns on the compacting station.

In such a case, if patterns are of various complex shapes it is preferable to utilize different compacting techniques. If, in this case, at one compacting station there is mounted said auxiliary actuating mechanism whereas at the other compacting station a mechanism for mold compaction by jolting is installed in place of the above one, this will substantially broaden the technological potentialities of the molding machine and permit the choice of a most expedient and efficient technique for simultaneous compacting of various shapes at different stations of the molding machine.

The above effect may be also attained by incorporating the power cylinder 9 into a jolting vehicle table which is being an integral part of any jolting mechanism. In such a case, the role of the pedestal 8 by which the flask-and-pattern accessories are supported during the squeeze, will be played by the jolting table of said jolting mechanism. If the casing of the power cylinder 9 is made integral with the piston of the jolting mechanism, this will enable the described mechanism to be employed as a single mold manufacturing mechanism without additional cost of assembly work for replacing the auxiliary actuating mechanism by the jolting mechanism.

In such design, the mushroom member 10 of the power cylinder 9 may be used at the same time as a device for holding down the pattern plate 13 against the surface of the jolting table which is necessary in mold compaction by jolting.

What we claim is:

1. Apparatus for making molds by sequential squeezing, said apparatus having a frame provided with at least one station for molding sand compaction, comprising:

a main squeeze cylinder mounted on said frame and including a movable power member mounted therein;

a top traverse and squeeze board provided opposite to the main squeeze cylinder to cooperate with the squeeze cylinder to compact sand in an assembly of flask and pattern accessories provided therebetween;

an auxiliary actuating mechanism including a power cylinder and a pedestal enclosing said power cylinder, said pedestal being mounted on and in tandem with said movable power member of said main squeeze cylinder, said power cylinder including a movable piston mounted therein;

said flask-and-pattern accessories consisting of an independently movable pattern, a pattern plate having said pattern mounted thereon, a stripper plate movable with respect to said pattern in the direction of squeezing, a flask with a filling frame mounted on said stripper plate for being filled with molding sand, said pattern being movable independently of the other parts of said flask-and-pattern accessories;

a sectional lock type clamping means for operatively clamping said movable piston of said power cylinder of said auxiliary actuating mechanism to said pattern, said clamping means comprising a clamping mushroom member connected with said movable piston of said power cylinder and a lug connected with said movable pattern, said clamping mushroom and said lug operatively connecting said movable piston with said independent movable pattern for the independent movement thereof along an axis common to said pattern and said movable piston and defining an axis of squeezing;

said auxiliary actuating mechanism being associated with said flask-and-pattern accessories for movement thereof so that when said pedestal moves, the flask-and-pattern accessories approach said squeeze board to carry out a mold squeezing operation;

stop means supported on said frame for supporting said movable piston of said power cylinder, said sectional lock type of clamping means enabling said auxiliary actuating mechanism and said pattern to be quickly connected and disconnected, and said stop means supporting said auxiliary actuating mechanism when the latter is disconnected from said pattern;

said movable power member and said movable piston having a common axis coinciding with the axis of squeezing, and said main squeeze cylinder during its preliminary stroke taking all transport clearances in said sectional lock type clamping means and the clearance between said pedestal and said pattern plate, said power cylinder during the mold squeezing operation moving in the direction of said top transverse and squeeze board to squeeze the molding by means of said stripper plate and together with said clamping means fixes said pattern relative to the frame, and upon completion of the mold squeezing operation said power member being lowered to support said auxiliary actuating means on said stop means to disconnect said clamping mushroom from said lug.

2. Apparatus as set forth in claim 1, wherein:

said pedestal is mounted on a free end of said movable power member of said main squeeze cylinder.

3. Apparatus as set forth in claim 1, wherein:

said sectional lock type clamping means is in the form of two engaging components, and said components are in the form of hook-slot type.

4. Apparatus as set forth in claim 3, wherein:

one of said engaging components of the clamping means comprises said lug having a through slot whose axis is parallel to said common axis, the other component of the clamping means comprising said clamping mushroom member fastened to the piston rod of the auxiliary actuating mechanism, and means connected to said piston rod for effecting proper orientation of the mushroom member in the center of said slot.

5. An apparatus as set forth in claim 4, wherein:

said means connected to the piston rod comprises a crossover connection applied to the auxiliary actuating mechanism piston rod and positioned at a predetermined height with respect to the pattern along the axis of squeezing, and said stop means comprises adjustable fixed stops, said crossover connection coming into contact with said stops with the auxiliary actuating mechanism piston rod in a lower position.

* * * * *